US006935265B1

(12) United States Patent
LaBrosse et al.

(10) Patent No.: US 6,935,265 B1
(45) Date of Patent: Aug. 30, 2005

(54) SKIN ON FRAME KAYAK AND KIT AND A COURSE INCORPORATING THE KIT

(75) Inventors: Michelle LaBrosse, Stateline, NV (US); Nicholas Schade, Glastonbury, CT (US)

(73) Assignee: Maklaf Holdings, Inc., Carson City, NV (US)

( * ) Notice: Subject to any disclaimer, the term of this patent is extended or adjusted under 35 U.S.C. 154(b) by 0 days.

(21) Appl. No.: 10/806,809

(22) Filed: Mar. 23, 2004

(51) Int. Cl.[7] ..... B63B 35/00
(52) U.S. Cl. ..... 114/347; 114/355
(58) Field of Search ..... 114/347, 357, 355

(56) References Cited

U.S. PATENT DOCUMENTS 1,930,770 A * 10/1933 Percy ..... 114/79 R
4,274,170 A * 6/1981 Simpson ..... 114/347
5,964,178 A * 10/1999 Gonda ..... 114/354

OTHER PUBLICATIONS

Chukchi Kayak, collected by N.I. Sokolnikov 1904-1907, The Museum of Ethnography of the Peoples of the USSR, Leningrad, Russia, drawn by Cheyl Skeam, 1977.
Maritime Chukchi Kayak, collected by A.E. Mordenskiold 1878-79, The Ethnographic Museum of Sweden, Stockholm, drawn by D.M. McClinton, 1981.

* cited by examiner

*Primary Examiner*—Stephen Avila
(74) *Attorney, Agent, or Firm*—John W. LaBatt; Hoffman, Warnick & D'Alessandro LLC

(57) ABSTRACT

A kit for building a unique skin on frame kayak. The kit can comprise various raw, precut, and/or preformed materials that can be used to build a kayak frame. Further, various materials can be included to build a finished kayak. The kit can be incorporated as part of a course to illustrate one or more principles of the course.

20 Claims, 6 Drawing Sheets

SKIN ON FRAME KAYAK AND KIT AND A COURSE INCORPORATING THE KIT

BACKGROUND OF THE INVENTION

1. Technical Field

The invention relates generally to kayaks, and more specifically, to a new design for a kayak that can be readily assembled, a kit for building the kayak, and a course that incorporates building the kayak.

2. Related Art

Kayaking is a popular recreational activity throughout the world. Typically, individuals purchase a manufactured kayak for use, although many individuals would enjoy building their own kayak. However, the amount of time typically required to build a kayak is prohibitive for most of these people.

As a result, a need exists for a new design for a kayak that can be readily assembled. In particular, a need exists for a kayak design and a kayak kit that allows an individual to build his/her own kayak within a reasonable amount of time. Further, a need exists for a course that incorporates building and/or using the kayak to illustrate one or more principles of the course.

SUMMARY OF THE INVENTION

The invention provides a skin on frame kayak, a kit for building the kayak, and a course that incorporates the kit. Specifically, under the present invention, a kit can be provided that includes various materials and assembly directions for building a kayak frame and/or the corresponding kayak. Based on the goals of the kit and/or relative skill level of the individual using the kit, the components can be provided as raw materials (e.g., boards), in a precut state (e.g., desired width and length), and/or a preformed state (e.g., desired width, length and shape). The kit can be used to provide a relaxed and fulfilling environment for illustrating various principles of a course.

A first aspect of the invention provides a kit for building a kayak, the kit comprising: a pair of gunwales; a keel; a plurality of stringers; a plurality of deck beams; a plurality of ribs; a first and a second breast hook; and a first and a second stem.

A second aspect of the invention provides a method of building a kayak frame, the method comprising: attaching a bow end of a first gunwale and a bow end of a second gunwale to a bow breast hook; attaching a stern end of the first gunwale and a stern end of the second gunwale to a stern breast hook; attaching a first deck beam to the first gunwale and the second gunwale on a first side of a center of the first gunwale and the second gunwale; attaching a second deck beam to the first gunwale and the second gunwale on a second side of the center; attaching a plurality of ribs to the first gunwale and the second gunwale; and attaching a plurality of stringers to the plurality of ribs.

A third aspect of the invention provides a project management course comprising: providing a set of course materials for illustrating at least one principle of the course, wherein the set of course materials comprises a kit for building a kayak; developing a strategy to assemble the kayak; assembling the kayak using the kit and the strategy; and evaluating the strategy based on the assembled kayak.

The illustrative aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, the invention provides a skin on frame kayak, a kit for building the kayak, and a course that incorporates the kit. Specifically, under the present invention, a kit can be provided that includes various materials and assembly directions for building a kayak frame and/or the corresponding kayak. Based on the goals of the kit and/or relative skill level of the individual using the kit, the components can be provided as raw materials (e.g., boards), in a precut state (e.g., desired width and length), and/or a preformed state (e.g., desired width, length and shape). The kit can be used to provide a relaxed and fulfilling environment for illustrating various principles of a course.

Figure 1:
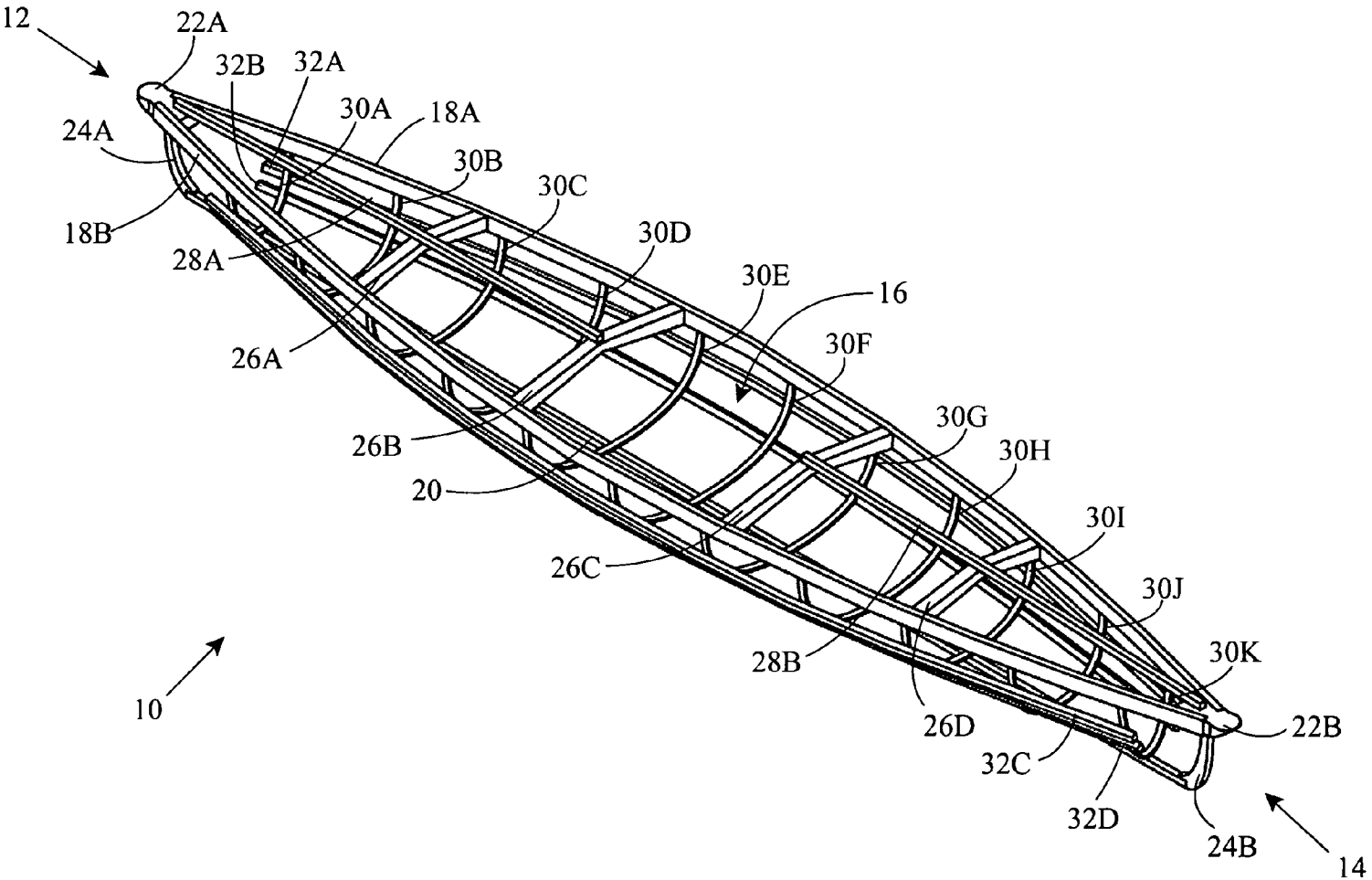
FIG. 1 shows a perspective view of an illustrative kayak frame.

Turning to the drawings, FIG. 1 shows an illustrative kayak frame 10 according to one embodiment of the invention. Kayak frame 10 includes a stern end 12, a bow end 14, and a cockpit 16. Cockpit 16 is shown located slightly closer to bow end 14 in an approximate center of the length of kayak frame 10. In general, the upper sides of kayak frame 10 are defined by a pair of gunwales 18A–B, and kayak frame 10 is defined along its bottom by a keel 20. Gunwales 18A–B are each attached to breast hooks 22A–B at stern end 12 and bow end 14, respectively. Further, stems 24A–B are also attached to breast hooks 22A–B, respectively, in an approximately perpendicular direction to gunwales 18A–B to define stern end 12 and bow end 14 in a vertical direction. Keel 20 is attached to stems 24A–B to define kayak frame 10 along its central bottom.

Additional support is provided along the top of kayak frame 10 by deck beams 26A–D. Deck beams 26B–C are shown located on either side of cockpit 16 and define its length. Additionally, deck stringers 28A–B are each shown attached to two deck beams 26A–D and the corresponding breast hooks 22A–B to provide further support and stability along the length of the top of kayak frame 10. The sides of kayak frame 10 are formed by a plurality of ribs 30A–K. Each rib 30A–K is attached at each end to gunwales 18A–B, and in an approximate midpoint to keel 20. Hull stringers 32A–D are shown attached to ribs 30A–K and provide additional support to kayak frame 10 for most of its length.

Figure 2:
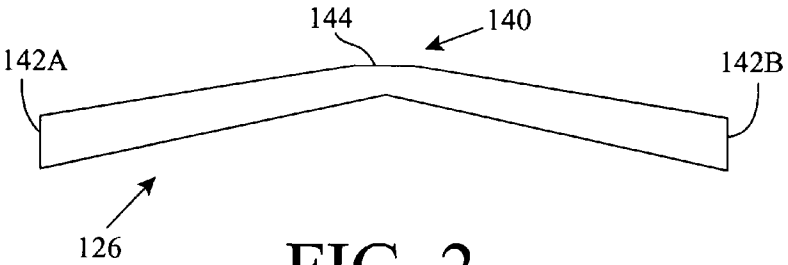
FIG. 2 shows a side view of an illustrative deck beam.

Additional aspects of the invention will be further described with respect to a particular kayak frame 10 in which cockpit 16 is configured to seat a single person. In this case, each gunwale 18A–B can comprise a length of approximately twelve feet. Deck beams 26B–C can define an opening for cockpit 16 of approximately thirty-one and a half inches. As noted previously, cockpit 16 can be located slightly closer to bow end 14. To this extent, deck beam 26B can be attached to gunwales 18A–B approximately thirteen inches in front of the center of kayak frame 10, while deck beam 26C can be attached to gunwales 18A–B approximately eighteen and a half inches behind the center of kayak frame 10. Deck beam 26A can be located approximately twenty-three inches in front of deck beam 26B, and deck beam 26D can be located approximately twenty-one inches behind deck beam 26C. FIG. 2 shows a side view of an illustrative deck beam 126. As shown, deck beam 126 has a center area 140 that is higher than ends 142A–B. Center area 140 is shown having a flat top portion 144 that readily allows for the attachment of deck stringers 28A–B (FIG. 1). In one embodiment, each deck beam 126 has a total width of approximately three and a half inches, a length that varies based on its location on kayak frame 10, and flat top portion 144 comprising a length of approximately one and a half inches.

Figures 3A, 3B:
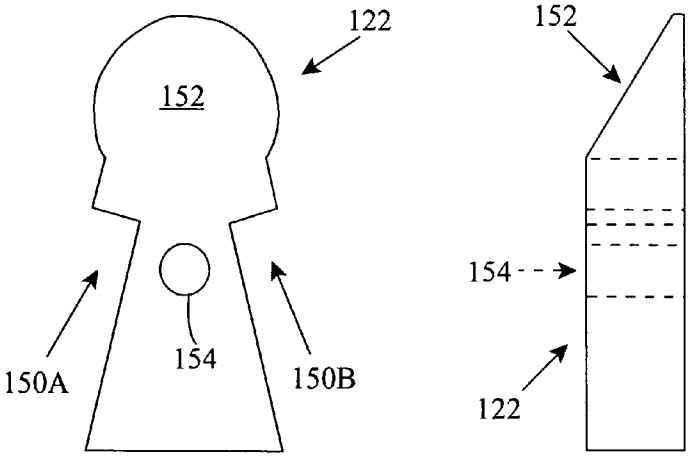
FIGS. 3A–B show a top and a side view, respectively, of an illustrative breast hook.

Returning to FIG. 1, each end of gunwales 18A–B is attached to a breast hook 22A–B. FIGS. 3A–B show a top view and side view of an illustrative breast hook 122, respectively. As shown, breast hook 122 includes two slots 150A–B that allow an end of each gunwale 18A–B to be readily attached. Further, an outer end 152 of breast hook 122 can be tapered and/or rounded to provide a slightly aerodynamic and visually pleasing end point for kayak frame 10 (FIG. 1). Additionally, breast hook 122 can include an aperture 154 that extends through breast hook 122 for inserting an end of a stem 24A–B (FIG. 1). Alternatively, aperture 154 can extend only partially through breast hook 122 from the bottom of breast hook 122. In one embodiment, aperture 154 comprises a diameter of approximately three quarters of an inch.

Figures 4A, 4B:
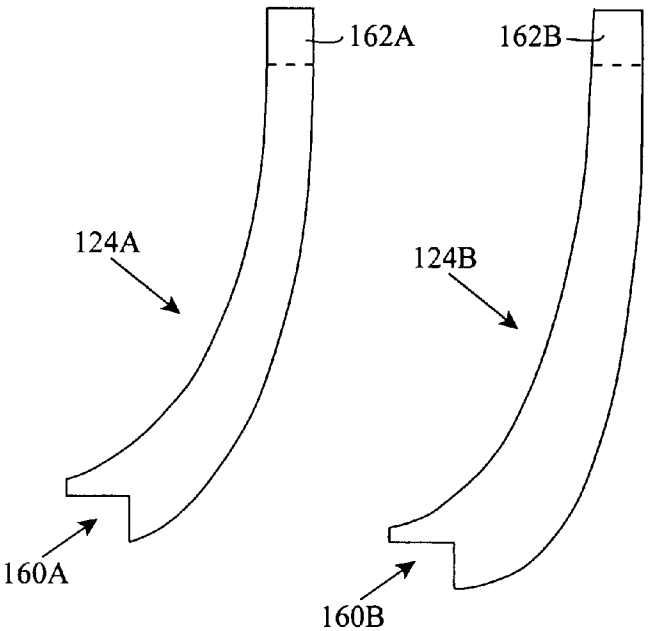
FIGS. 4A–B show a side view of an illustrative stern and bow stem, respectively.

As shown in FIG. 1, stems 24A–B define the vertical leading and trailing edges of kayak frame 10, respectively. FIGS. 4A–B show side views of illustrative stems 124A, 124B, respectively. Stem 124A is configured to be attached at stern end 12 (FIG. 1) of kayak frame 10, while stem 124B is configured to be attached at bow end 14 (FIG. 1) of kayak frame 10. As shown, stem 124B can be slightly longer and thicker than stem 124A. For example, stem 124A can have a total length of approximately eight and seven sixteenths inches and a total width of approximately three and seven eighths inches, while stem 124B can have a total length of approximately nine and three sixteenths inches and a total width of approximately four inches. Each stem 124A–B is shown including a notch 160A–B, respectively, that allows each end of keel 20 (FIG. 1) to be attached to stems 124A–B. Further, the opposing end of each stem 124A B can include a rounded portion 162A–B for insertion into aperture 154 (FIG. 3A) of the corresponding breast hook 122 (FIG. 3A).

Returning to FIG. 1, eleven ribs 30A–K can be attached to gunwales 18A–B in intervals of approximately twelve inches on center. Ribs 30A–K can also be located slightly closer to bow end 14 than stern end 12. To this extent, rib 30A can be attached to gunwales 18A–B approximately fourteen inches on center from stern end 12, which will result in rib 30K being attached approximately ten inches on center from bow end 14. Each rib 30A–K can have a length that is sufficient to attach each end to gunwales 18A–B and also be attached in an approximate center to keel 20 while keel 20 remains substantially unbent. Further, each rib 30A–K should be rounded so that the corresponding sides of kayak frame 10 are rounded. For example, ribs 30A, 30K can each have a length of approximately twenty-one inches, while ribs 30E–G can each have a length of approximately thirty-six inches. The remaining ribs can have dimensions that vary gradually between these lengths. Hull stringers 32A–D can each have a length of approximately one hundred twenty five inches so that each hull stringer 32A–D can be attached to each rib 30A–K with some additional length that can extend beyond ribs 30A, 30K.

Figure 5:
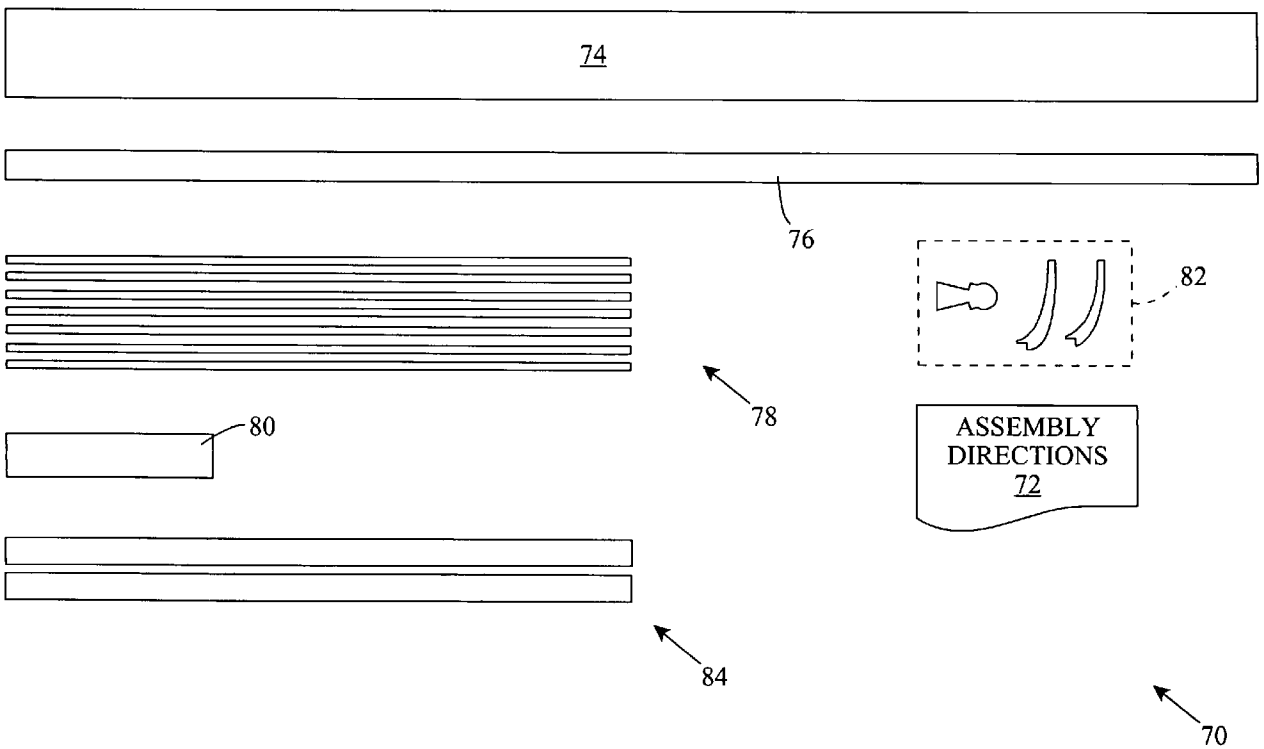
FIG. 5 shows an illustrative kit for building a kayak frame.

Materials for each of the components (e.g., gunwales, ribs, stringers, breast hooks, etc.) shown in FIG. 1 for kayak frame 10 can be included in a kit for building kayak frame 10. Various kits can be provided to conform to an estimated amount of time for assembling kayak frame 10 and/or an expertise level of the individual(s) assembling kayak frame 10. For example, FIG. 5 shows an illustrative kit 70 that comprises raw materials for creating components for kayak frame 10, and will be discussed in conjunction with FIG. 1. Kit 70 can include assembly instructions 72 that detail how to correctly cut and/or form the materials into each of the components, and assemble the various components to create kayak frame 10.

In this embodiment, kit 70 is shown including a first board 74 that measures one-by-ten (e.g., approximately ¾" thick and approximately 10" wide) and having a length of approximately twelve feet. Board 74 can comprise pine, spruce, fir, cedar, or the like, and can be used to cut each gunwale 18A–B (e.g., 144"×1¾"×¾"), each hull stringer 32A–D (e.g., 125"×¾"×¾"), keel 20 (e.g., 144"×¾"×¾"), deck stringer 28A (e.g., 57½"×¾"×¾"), and deck stringer 28B (e.g., 52¼"×¾"×¾"). Kit 70 is also shown including a two-by-four board 76 (e.g., 1½" thick and 3½" wide) comprising pine, spruce, fir, cedar, or the like, and having a length of approximately twelve feet. Board 76 can be used to cut each deck beam 26A–D (e.g., 23½" long, and then cut to the appropriate length), and each breast hook 22A–B (e.g., 6⅝" long). Kit 70 can further include a set (e.g., seven or more) of boards 78 comprising oak, ash, cedar, or the like from which ribs 30A–K can be cut. Set of boards 78 can comprise a plurality of three quarters of an inch wide by one quarter of an inch thick boards, each having a length of approximately six feet. Kit 70 can further include a five inches wide by three quarters of an inch thick board 80 comprising pine, spruce, or the like, and having a length of approximately two feet, from which stems 24A–B could be formed.

Since kit 70 will require an individual to cut and form the various components, kit 70 can include a set (e.g., one or more) of templates 82 that can be used to cut various pieces to the correct size and shape. For example, set of templates 82 can include a template for cutting breast hooks 22A–B, templates for stems 24A–B, etc. Further, since ribs 30A–K will require bending into shape, assembly instructions 72 can include instructions on how to bend ribs 30A–K, and/or instructions on how to create one or more forms that can be used to obtain a desired bend for each rib 30A–K.

Figure 6:
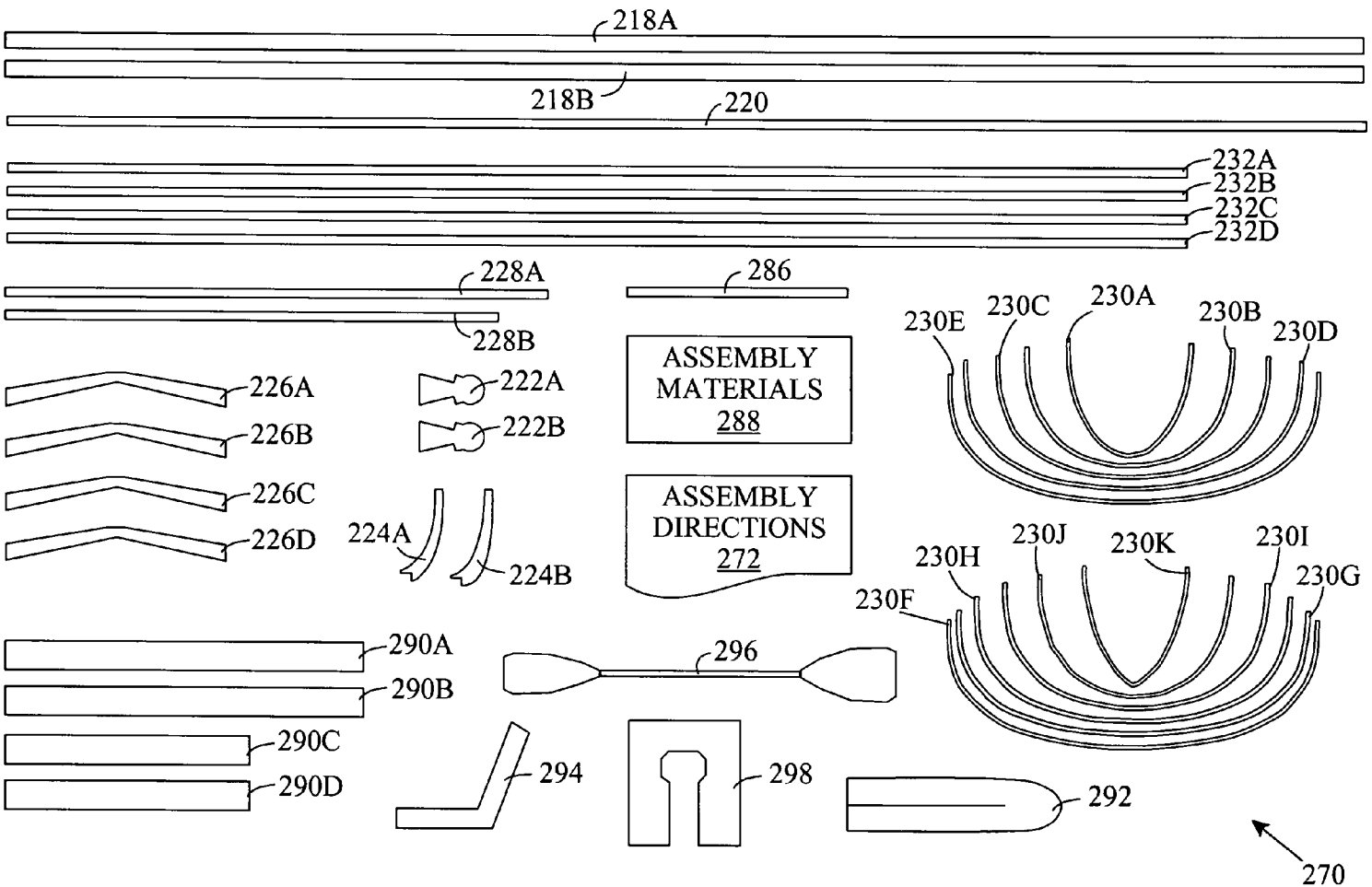
FIG. 6 shows an illustrative kit for building a kayak.

A kit, such as kit 70, can further include additional components for assembling a kayak that incorporates kayak frame 10 (FIG. 1). Additionally, an alternative kit can include one or more of the components for kayak frame 10 in a precut and/or preformed state. For example, FIG. 6 shows an illustrative kit 270 that includes gunwales 218A–B, keel 220, hull stringers 232A–D, and deck stringers 228A–B that are each precut to a desired length. Further, deck beams 226A–D, stems 224A–B, and breast hooks 222A–B could be provided precut to the appropriate size and preformed to the desired shape. The various ribs 230A–K can also be provided precut to the desired lengths and pre-steamed and bent into the approximate shape. In addition to precutting the various components, one or more components can comprise one or more features to facilitate attaching two or more components. For example, gunwales 218A–B can include mortise holes (e.g., slots) to readily allow insertion of ribs 230A–K at the desired locations. Further, breast hooks 222A–B can each include a mortise hole for insertion of stems 224A–B.

In any event, a kit can comprise various other tools and components for assembling kayak frame 10 (FIG. 1). For example, kit 270 is shown including assembly materials 288 that can comprise one or more of lashing, tacks, screws, glue, pins, cord, dowels, and the like, for use in assembling the various components of kayak frame 10. Further, one or more temporary supports can be provided to assist in obtaining a desired shape of kayak frame 10. For example, a spacer 286 having a length of approximately two feet could be included in kit 270 and/or cut from board 74 (FIG. 5) to temporarily hold apart the approximate centers of gunwales 218A–B while the respective ends of gunwales 218A–B are attached to breast hooks 222A–B, and deck beams 226A–D are attached to gunwales 218A–B.

In addition to the various components discussed above for kayak frame 10 (FIG. 1), kit 270 and/or kit 70 (FIG. 5) could comprise additional components of a kayak and/or kayak related components. For example, floor boards 290A–D could be included and attached to kayak frame 10 within cockpit 16 (FIG. 1) to provide support for an individual getting into and out of the kayak. In one embodiment, floor boards 290A–D can comprise two center floor boards 290A–B made of cedar, pine, spruce, or the like, that are approximately thirty-eight inches long, three inches wide, and one quarter of an inch thick, and two side floor boards 290C–D that are approximately twenty-six inches long. Further, a skin 292 for the kayak could be included. Skin 292 could comprise, for example, heat shrinkable polyester or the like having a length of approximately thirteen feet, a width of approximately sixty-six inches, and a thickness of approximately sixteen ounces. Various other components for applying the skin to kayak frame 10, such as lashing, sewing twine, skin edge cord, tacks, etc., can also be included as part of assembly materials 288. Still further, various other components related to using the kayak can be included in the kit. For example, kit 270 can include a seat 294 for sitting in cockpit 16, a paddle 296, and/or a personal flotation device 298.

Figure 7:
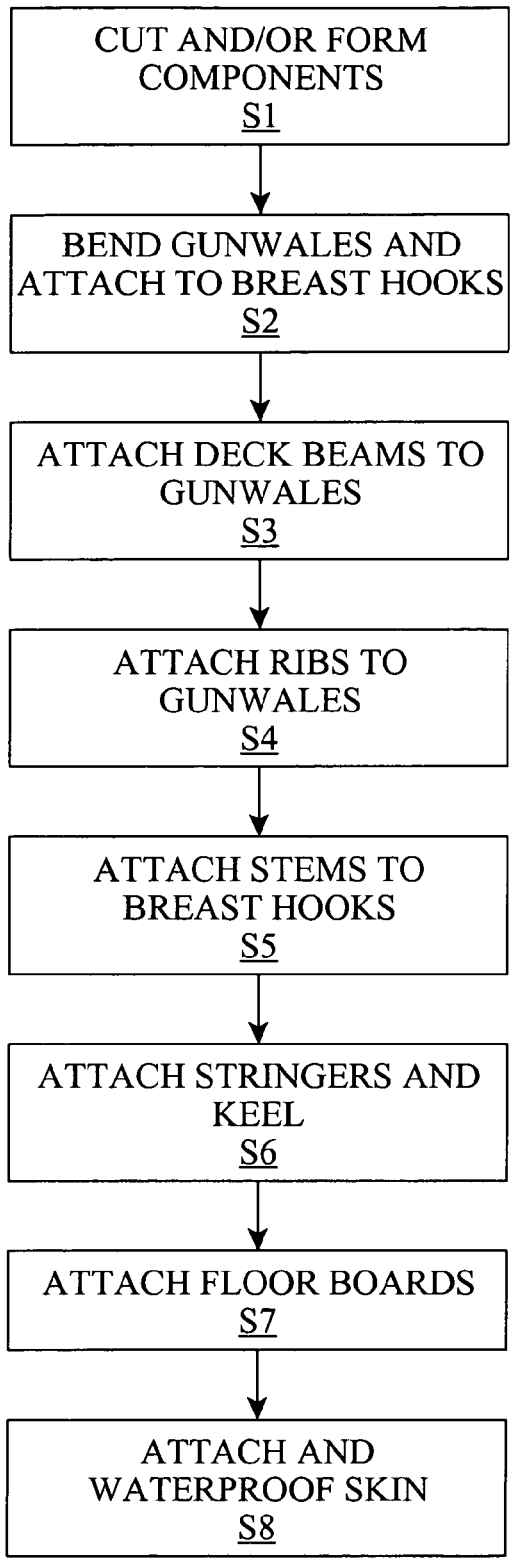
FIG. 7 shows illustrative method steps for assembling a kayak using the kit shown in FIG. 6.

As previously noted, assembly directions 72 (FIG. 5), 272 can be included in kits 70 (FIG. 5), 270, respectively. FIG. 7 shows a set of illustrative method steps for assembling kayak frame 10 (FIG. 1) that could be outlined in assembly directions 72, 272. In step S1, one or more components of kayak frame 10 can be cut and/or formed. For example, for kit 70, gunwales 18A–B (FIG. 1), hull stringers 32A–D (FIG. 1), keel 20 (FIG. 1), and deck stringers 28A–B (FIG. 1) can be cut from board 70 (FIG. 5). Further, various components, such as ribs 30A–K (FIG. 1) can be formed into a desired shape. It is understood, however, that step S1 may not be performed when kit 270 (FIG. 6) is used.

In any event, in step S2, gunwales 18A–B (FIG. 1) are bent and attached to breast hooks 22A–B (FIG. 1). In one embodiment, this step comprises temporarily attaching spacer 286 (FIG. 5) to an approximate center of each gunwale 18A–B. Subsequently, a bow end of each gunwale 18A–B can be attached to breast hook 22A, and a stern end of each gunwale can be attached to breast hook 22B. Each end of gunwales 18A–B can be attached to breast hooks 22A–B using, for example, one or more screws.

In step S3, deck beams 26A–D (FIG. 1) can be attached to gunwales 18A–B (FIG. 1). In one embodiment, each deck beam 26A–D is provided cut to a desired length. Alternatively, each deck beam 26A–D could be provided cut to a maximum length, and one or more deck beams 26A–D could require trimming by an individual. Deck beams 26A–D could be attached to gunwales 18A–B using, for example, one or more screws and/or one or more dowels that are inserted into deck beams 26A–D and gunwales 18A–B and glued into place. In step S4, ribs 30A–K (FIG. 1) are attached to gunwales 18A–B. As shown in FIG. 6, for example, each rib 230A–K can be provided pre-cut and pre-formed to a desired length/shape. Further, ribs 30A–K and/or gunwales 18A–B can be marked with an indication (e.g., color and/or alphanumeric coding) as to an approximate location on gunwales 18A–B that the corresponding rib 30A–K is to be attached. In one embodiment, an end of each rib 30A–K is inserted into a mortise hole that is included on gunwales 18A–B, and a peg can be inserted through each gunwale 18A–B and rib 30A–K to provide additional support.

In step S5, stems 24A–B (FIG. 1) are attached to breast hooks 22A–B (FIG. 1), respectively. In one embodiment, each stem 24A–B is inserted into a mortise hole in the corresponding breast hook 22A–B. In step S6, keel 20 (FIG. 1) can be attached to each stem 24A–B and ribs 30A–K (FIG. 1). In particular, keel 20 may be cut to a length that rests on each rib 30A–K, while each end of keel 20 extends into a corresponding notch 160A–B (FIGS. 4A–B). Further, keel 20 should be attached so that it travels a relatively straight path between each stem 24A–B. Also in step S6, hull stringers 32A–D (FIG. 1) can be attached to ribs 30A–K and deck stringers 28A–B (FIG. 1) can be attached to deck beams 26A–D to prevent the skin from touching ribs 30A–K, and to provide additional support for kayak frame 10 (FIG. 1). Each hull stringer 32A–D and/or deck stringer 28A–B can have tapered ends so that a skin attached to kayak frame 10 (FIG. 1) is not pushed outward as much as it would if the ends were not tapered.

As noted previously, additional components can be attached to kayak frame 10 (FIG. 1) to create a usable kayak. For example, in step S7, floor boards 290A–D (FIG. 6) can be attached to cockpit area 16 (FIG. 1) of kayak frame 10 to provide an even surface for an individual to sit and to protect the bottom of the kayak from a misstep. In step S8, skin 292 can be attached to kayak frame 10. In one embodiment, skin 292 is draped over kayak frame 10 while it is upside down, skin 292 is properly aligned and temporarily pinned into place around kayak frame 10, and excess skin 292 is removed. The portion of skin 292 that covers cockpit area 16 can be removed, skin 292 can be sewn along each deck stringer 28A–B, and skin 292 can be shrunk by heating skin 292 with a hot iron or the like. If skin 292 is not waterproof, then skin 292 can be made waterproof by, for example, painting skin 292 with one or two coats of a waterproof paint such as an exterior latex or the like.

Either kayak kit 70 (FIG. 5), 270 (FIG. 6) can be included as part of a set of course materials provided for a course. For example, kayak kit 70 could be provided as part of the course materials for a woodworking course. To this extent, the various components of kayak frame 10 (FIG. 1) can be attached using several different solutions known in the woodworking art to illustrate some of the numerous techniques of attaching the components to one another. For example, the course could illustrate traditional solutions that were once used and/or modern solutions for attaching various components. Further, assembly directions 72 (FIG. 5) and/or 272 (FIG. 6) could include instructions for two or more individuals to build kayak frame 10. As a result, various lessons on teamwork can be illustrated with a real life project. To this extent, if kayak frame 10 is to be built, for example, by a team of two individuals, then kayak frame 10 can have dimensions and the corresponding materials to build a two-person kayak.

Figure 8:
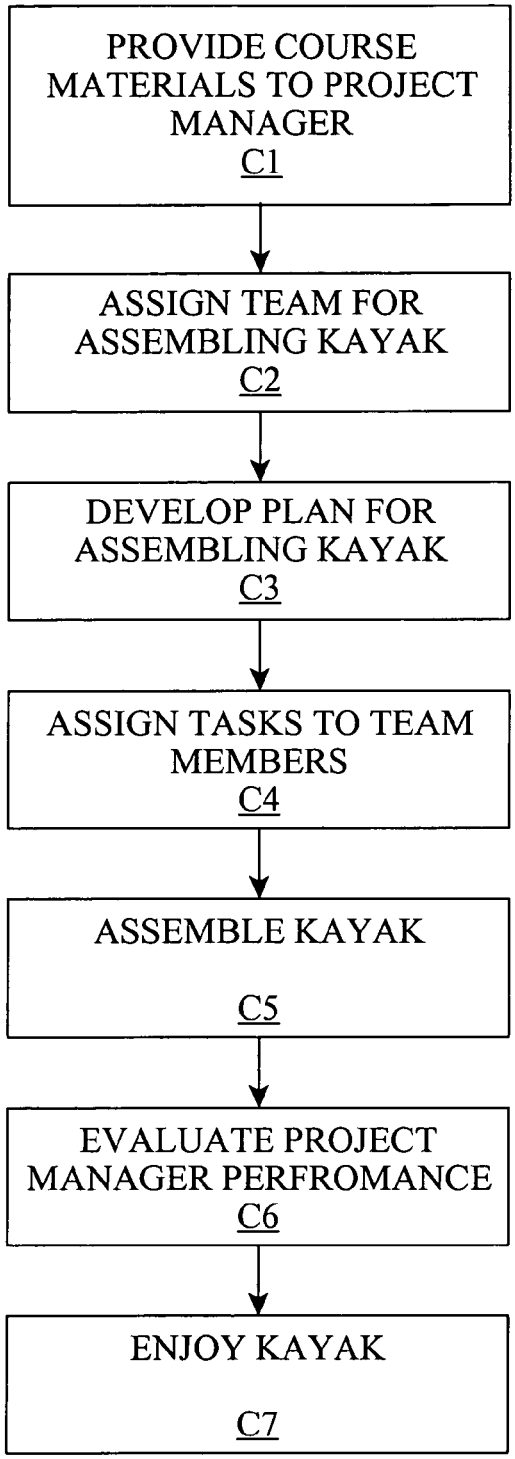
FIG. 8 shows illustrative method steps for incorporating a kayak kit into a project management course.

Still further, kit 70 (FIG. 5) and/or 270 (FIG. 6) could be incorporated into a course that teaches and/or evaluates the skills of a project manager. Various skills of the project manager can be illustrated and/or evaluated using either kit 70 or 270. For example, FIG. 8 shows an illustrative method for teaching/evaluating project management skills according to one embodiment of the invention. In step C1, a set of course materials are provided to a project manager that is being taught/evaluated in the course. The course materials will include a kayak kit, e.g., kit 70 and/or 270. In step C2, a team (e.g., two or more) of individuals can be assigned to the project manager for assembling the kayak using the kit.

Subsequently, the project manager can develop a strategy for assembling the kayak. In particular, in step C3, the project manager can develop a plan that the team will subsequently follow to assemble the kayak. In general, other course material or the like can be incorporated to assist the project manager in properly developing the plan. For example, particular rules and/or standards can be illustrated and used by the project manager to implement an effective plan. To this extent, the plan may comprise determining the set of tasks to complete, scheduling the performance of the various tasks, and the like. In step C4, the project manager can assign the various tasks required to be implemented in the plan to the team members. To this extent, the project manager may set up various teaming rules that can be outlined in other parts of the course materials. For example, the project manager may select to partner individuals on complicated tasks, assign multiple individuals to tasks that require multiple people, select individuals to perform certain tasks based on their skill level, etc.

Once the strategy has been developed, in step C5, the team assembles the kayak. During this time, the project manager may need to make adjustments to the plan and/or assignments based on how the assembly of the kayak is progressing. In step C6, the performance of the project manager can be evaluated based on whether the assembly remained on schedule, the quality of work performed, the amount of downtime that one or more team members experienced, whether there were any process hold ups, whether the respective skills of the team members were taken into account, etc. In this light, the performance of the project manager can be critiqued as a reflection of the team's performance. Subsequently, in step C7, the project manager and/or team members can enjoy their work by taking a relaxing paddle using the kayak that was built. As a result, kits 70, 270 provide an effective teaching/evaluation tool that naturally creates a fun and rewarding environment for the participants.

The foregoing description of various embodiments of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A kit for building a kayak, the kit comprising:
- a pair of gunwales, wherein each of the pair of gunwales comprises a plurality of mortise holes;
- a keel;
- a plurality of stringers;
- a plurality of deck beams;
- a plurality of ribs;
- a first and a second breast hook; and
- a first and a second stem.

2. The kayak kit of claim 1, further comprising a skin.

3. The kayak kit of claim 1, further comprising a seat.

4. The kayak kit of claim 1, further comprising assembly directions.

5. The kayak kit of claim 1, wherein the plurality of stringers comprise:
- a plurality of hull stringers;
- a stern deck stringer; and
- a bow deck stringer.

6. The kayak kit of claim 1, further comprising a spacer.

7. The kayak kit of claim 1, further comprising a plurality of floor boards.

8. The kayak kit of claim 1, further comprising assembly materials.

9. The kayak kit of claim 1, wherein each of the plurality of ribs comprises a bend.

10. The kayak kit of claim 1, further comprising a paddle.

11. The kayak kit of claim 1, further comprising a personal floatation device.

12. A method of building kayak frame, the method comprising:
- attaching a bow end of a first gunwale and a bow end of a second gunwale to a bow breast hook;
- attaching a stern end of the first gunwale and a stern end of the second gunwale to a stern breast hook;
- temporarily attaching a spacer between the first gunwale and the second gunwale approximate center of the first and second gunwales;
- attaching a first deck beam to the first gunwale and the second gunwale on a first side of a center of the first gunwale and the second gunwale;
- attaching a second deck beam to the first gunwale and the second gunwale on a second side of the center;
- attaching a plurality of rib to the first gunwale and the second gunwale; and
- attaching a plurality of stringers to the plurality of ribs.

13. The method of claim 12, further comprising attaching a plurality of floor boards to a cockpit area of the kayak.

14. The method of claim 12, further comprising attaching a skin to the kayak frame.

15. The method of claim 12, further comprising:
- attaching a bow stem to the bow breast hook; and
- attaching a stern stem to the stern breast hook.

16. A kit for building a kayak, the kit comprising:

a set of materials for a plurality of kayak components for the kayak, wherein the plurality of kayak components includes a pair of gunwales, a keel, a plurality of stringers, a plurality of deck beams, a plurality of ribs, a first breast hook, a second breast hook, a first stem and a second stem, and wherein the set of materials includes at least one board from which at least one of the plurality of kayak components can be cut; and a set of templates, wherein each template in the set of template can be used to form at least one of the plurality of kayak components.

17. The kayak kit of claim 16, wherein the set of materials further includes at least one of the plurality of kayak components in a preformed state.

18. The kayak kit of claim 16, further including assembly instructions.

19. The kayak kit of claim 18, wherein the assembly instructions include instructions on forming at least one of the plurality of kayak components.

20. The kayak kit of claim 16, further comprising a skin.

* * * * *

UNITED STATES PATENT AND TRADEMARK OFFICE

CERTIFICATE OF CORRECTION

PATENT NO. : 6,935,265 B1
DATED : August 30, 2005
INVENTOR(S) : LaBrosse et al.

It is certified that error appears in the above-identified patent and that said Letters Patent is hereby corrected as shown below:

Column 8,
Line 51, please insert -- at an -- before the word “approximate”.
Line 58, please replace the word “rib” with the word -- ribs --.

Signed and Sealed this

Fifteenth Day of November, 2005

JON W. DUDAS
*Director of the United States Patent and Trademark Office*